US006585860B2

(12) United States Patent
Ruf et al.

(10) Patent No.: US 6,585,860 B2
(45) Date of Patent: Jul. 1, 2003

(54) METHOD TO CONTROL OR REGULATE THE BASIS WEIGHT OF A PAPER OR CARDBOARD WEB

(75) Inventors: Wolfgang Ruf, Herbrechtingen-Bolheim (DE); Hans Loser, Langenau (DE); Klaus Lehleiter, Mengen (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 10/079,413

(22) Filed: Feb. 22, 2002

(65) Prior Publication Data

US 2002/0117282 A1 Aug. 29, 2002

Related U.S. Application Data

(62) Division of application No. 09/136,400, filed on Aug. 19, 1998, now Pat. No. 6,368,461.

(30) Foreign Application Priority Data

Aug. 20, 1997 (DE) ..... 197 36 047

(51) Int. Cl.[7] ..... D21G 9/00; D21F 1/08; G05D 7/00

(52) U.S. Cl. ..... 162/198; 162/190; 162/DIG. 10; 162/DIG. 11; 700/128

(58) Field of Search ..... 162/198, 190, 162/DIG. 10, DIG. 11, 202–204, 253, 258, 259; 700/127–129

(56) References Cited

U.S. PATENT DOCUMENTS

| | | | | |
|---|---|---|---|---|
| 3,619,360 A | | 11/1971 | Persick, Jr. | |
| 3,981,767 A | | 9/1976 | Al-Shaikh | |
| 4,098,641 A | | 7/1978 | Casey et al. | |
| 4,374,703 A | * | 2/1983 | Lebeau et al. | 162/253 |
| 5,560,807 A | | 10/1996 | Hauser | |
| 5,674,364 A | | 10/1997 | Pitkajarvi | |

(List continued on next page.)

FOREIGN PATENT DOCUMENTS

| | | |
|---|---|---|
| DE | 2019975 | 11/1971 |
| DE | 2432836 | 1/1975 |
| DE | 2708390 | 9/1977 |
| DE | 2926072 | 1/1980 |
| DE | 3535849 | 4/1987 |
| DE | 4000363 | 5/1990 |
| DE | 4005281 | 8/1991 |
| DE | 4019593 | 1/1992 |
| DE | 4238037 | 4/1993 |
| DE | 4239845 | 5/1993 |
| DE | 4239270 | 5/1994 |

OTHER PUBLICATIONS

Gräser, "Zur Vorhersage der Regelgenauigkeit geschlossener Regelkreise am Beispiel der Flächengewichtsregelung," *Wochenblatt Für Papierfabrikation*, 21, pp. 891–895 (1993).

*Primary Examiner*—Jose A. Fortuna
(74) *Attorney, Agent, or Firm*—Greenblum & Bernstein, P.L.C.

(57) ABSTRACT

Method for regulating a basis weight of a paper or cardboard web in the manufacturing process. The method includes determining a basis weight at an end of the manufacturing process, calculating a deviation of the determined basis weight from a predetermined target value, adjusting a concentration of a material suspension supplied to a headbox via a first control loop such that the calculated deviation is corrected, one of directly and indirectly measuring a basis weight of a resulting web in a region upstream, with regard to a web travel direction, a drying section, and supplying a signal related to the measured basis weight to a second control loop.

7 Claims, 6 Drawing Sheets

U.S. PATENT DOCUMENTS 5,707,495 A 1/1998 Heinzmann et al.
5,746,889 A 5/1998 Huovila et al.
5,795,441 A 8/1998 Lehleiter et al.
5,814,191 A 9/1998 Huovila
5,825,653 A 10/1998 Huovila et al.
5,843,281 A * 12/1998 Huovila ..... 162/216
5,885,420 A 3/1999 Heinzmann et al.
5,891,306 A * 4/1999 Chase et al. ..... 162/198
5,900,121 A 5/1999 Lehleiter et al.
5,928,475 A 7/1999 Chase et al.
5,944,957 A * 8/1999 Fagerlund et al. ..... 162/258
5,958,189 A 9/1999 Begemann et al.
6,006,602 A * 12/1999 Preston et al. ..... 73/159
6,080,278 A * 6/2000 Heaven et al. ..... 162/198
6,086,716 A * 7/2000 Watson et al. ..... 162/198
6,204,672 B1 * 3/2001 Chase ..... 324/695
6,251,225 B1 * 6/2001 Ruf et al. ..... 162/198
6,258,213 B1 * 7/2001 Fagerlund et al. ..... 162/198
6,284,100 B1 * 9/2001 Shakespeare et al. ..... 162/198

* cited by examiner

METHOD TO CONTROL OR REGULATE THE BASIS WEIGHT OF A PAPER OR CARDBOARD WEB

CROSS-REFERENCE TO RELATED APPLICATIONS

The present application is a divisional of U.S. patent application Ser. No. 09/136,400 filed Aug. 19, 1998, now U.S. Pat. No. 6,368,461B1, and claims priority under 35 U.S.C. §119 of German Patent Application No. 197 36 047.5 filed on Aug. 20, 1997, the disclosures of which are expressly incorporated by reference herein in their entireties.

BACKGROUND OF THE INVENTION

1. Field of the Invention

The present invention relates to a method to control or regulate the basis weight of a paper or cardboard web in the manufacturing process.

2. Discussion of Background Information

An essential quality factor of a paper or cardboard web is the uniformity of the basis weight of the manufactured web. In the manufacturing process of such a web, several interfering factors may arise that can adversely affect or influence the uniformity of the basis weight both across the machine width and in the longitudinal direction. These interfering factors include, e.g., temperature variations, pressure variations, finishing tolerances, and also include, e.g., errors in the operation or adjustment of the machine in the manufacturing process. To substantially eliminate these negative interfering factors and to obtain a uniform production of the paper or cardboard web, devices and methods for controlling and regulating the basis weight, particularly the cross-direction profile of the basis weight, are used.

Patent document DE 35 35 849 discloses changing the width of an outflow opening of a headbox at certain points along the web width so that the throughput of the material suspension is locally altered. However, if the throughput of the material suspension changes locally at an identical concentration over the machine width, the quantity of solids at this point in the web relative to the web width is influenced, which can change the basis weight at this point on this web strip.

In patent application DE 40 19 593, a device and method for regulating the basis-weight cross-direction profile of the web is disclosed. In accordance with this document, when the basis-weight cross-direction profile of the paper or cardboard web deviates at a particular point in the width of the web, the concentration of the material suspension flow should be adjusted or modified at this point. In order to perform this, the above-noted document discloses a headbox to be sectioned at least partially over the machine width with each section to be provided with an individually adjustable concentration via controlled section flows. The individual adjustment of the concentration of a respective section flow occurs through a regulation of the feed stream conditions of two individual flows of constant but different concentrations. Due to the different solid matter content of the section streams, a change of the basis weight results at the corresponding points in the web width.

In the control method utilized above, the basis-weight cross-direction profile of the paper or cardboard web is measured at the end of the paper or cardboard machine and the aperture at the headbox or the feed stream conditions of the individual streams of different concentration are regulated for respective sections via a control loop.

Such a control method with measuring basis-weight cross-direction profile is also known, for example, from patent application DE 40 05 281 or DE 42 38 037. In the above-mentioned documents, the basis-weight cross-direction profile of the paper or cardboard web is measured at the end of the paper or cardboard machine and the necessary adjustment of actuators is performed via a process control system for sectional regulation of the basis-weight.

Also known, e.g., from the disclosure patent document DE 20 19 975, the disclosure of which is expressly incorporated by reference herein in its entirety, is the technique of determining the actual basis-weight cross-direction profile and the actual basis-weight longitudinal profile on a running web with the aid of two sensors. The sensors measure a diagonal profile and a longitudinal profile, and utilize this information to control the web or regulate the basis-weight of a web.

The above-noted control methods substantially control the cross-direction profiles of the paper or cardboard web. It is also known to utilize, during the manufacturing process of a paper or cardboard web, a control loop that measures the basis-weight of the finished paper or cardboard web, which is generally the mean value of the measured cross-direction profile. Based upon the measured basis weight, the material amount supplied to the screen loop is regulated and the basis-weight of the produced paper or cardboard web is adjusted.

Moreover, in the above-noted prior art, the known regulation of the basis weight has a relatively sluggish behavior with long reaction times.

SUMMARY OF THE INVENTION

In accordance with the present invention, known paper or cardboard machines and methods can be enhanced to provide a regulation of the basis weight with a shorter reaction time than the prior art devices. In this manner, short wavelength variations in the manufactured paper or cardboard web can be controlled relative to the running time of the paper or cardboard web through the paper or cardboard machine.

The present invention is directed to a paper or cardboard machine that regulates the basis weight of a produced paper or cardboard web during the manufacturing process. The paper or cardboard machine includes at least one headbox for a machine-wide distribution of a material suspension either onto a screen or between two screens, at least one material suspension supply coupled to the headbox with at least one concentration, and at least one initial control loop (I). The at least one initial control loop (I) includes at least one actuator for adjusting the at least one concentration of the at least one supplied material suspension, at least one device for determining a basis weight of the finished web, at least one concentration modifier for modifying the at least one concentration of the at least one material suspension supplied to the headbox, and at least one device for adjusting the at least one actuator for adjusting the at least one concentration of the at least one material suspension supplied. The paper or cardboard machine also includes at least one second control loop (II) for further regulating the concentration of the material suspension supplied to the headbox.

Accordingly, the present invention improves the prior art paper or cardboard machine with regulation of the basis weight of a paper or cardboard web in the manufacturing process by utilizing at least a second control loop for regulating the concentration of the material suspension supplied to the headbox.

A further feature of the paper or cardboard machine of the present invention is that the second control loop includes at least one device for either the direct or indirect determination of the basis weight of the resulting web.

In accordance with another embodiment of the present invention, the device for either the direct or indirect determination of the basis weight of the resulting web is positioned in a wet area of the paper or cardboard machine. This positioning may be utilized to obtain measurement directly behind the headbox jet, e.g., with a radiometric sensor. Further, the ability to measure the height of the material suspension on an extended screen is possible. This measurement may advantageously occur, e.g., preferably behind a first roll and prior to a first draining unit so as to substantially avoid influences that arise through the draining unit. However, if it is necessary, e.g., for reasons of space requirements or other prevailing conditions, measuring may be alternatively performed after the first draining unit. Further, even in a double-screen environment, the basis weight of the resulting web can be determined in the wet section, e.g., with the radiometric measurement.

In another embodiment of the present invention, the headbox can have two material supplies provided with different material concentrations, e.g., $C_L$ and $C_H$. These material supplies may be formed so that at least one of the two material supplies is divided at the headbox into section streams that are to be individually controlled. In this regard, reference is made to the above-noted prior art documents, which disclose various embodiments of headboxes that are controllable for consistency.

In accordance with another aspect of the present invention, one of the two material supplies may be coupled to a thinning or thickening fluid supply that is to be regulated by the second control loop. For example, the thinning supply may be screen water, and the thickener supply may include additional thick matter to be controllably introduced into one of the two material supplies. Other thinning or thickening fluids can also be used, e.g., clarified water, clarified filtrate, or material suspension having a higher concentration.

In another embodiment of the present invention, if fibrous materials or ash content of the forming paper or cardboard are measured separately by the second sensor located within the wet section of the paper or cardboard machine or if information related to these properties is received via the paper or cardboard material consistency sensor, the corresponding, individual deficiencies of fibrous materials or ash can be supplied in a targeted manner so as to compensate for the measured deficiency. Accordingly, two different sensors may be utilized to measure fibrous materials and ash contend in the resulting web in accordance with the present invention without departing from the scope of the invention.

In accordance with the method of the present invention, the prior art process for regulating the basis weight of a paper or cardboard web, e.g., in which the basis weight of the web is determined at the end of the manufacturing process, a variation of the determined value is calculated from a predetermined target value, and the concentration of the material suspension supplied to the headbox is adjusted to correct the calculated deviation, is improved such that the basis weight of the resulting web is measured either directly or indirectly in a region located before the drying section and the measured basis weight is supplied to a second control loop.

In accordance with another alternative embodiment of the present invention, the second control loop regulates the concentration of the material suspension supplied to the headbox.

The process of the present invention further provides that the concentration of the material suspension supplied to the headbox is regulated via the second control loop by supplying either a thinning or thickening fluid in variable amounts to the material suspension supply to the headbox.

Another embodiment of the process includes two suspension streams having different concentrations. The two suspension streams are supplied to the headbox and the regulation of the concentration of at least one of the material supplies is influenced by the second control loop. In this manner, actuators, e.g., throttle valves or speed-regulated pumps, may be controlled in accordance with the measured requirements.

In accordance with another embodiment of the present invention, the second control loop may engage in the existing material density regulation with a consistency-controlled headbox throughout the machine. In this manner, all actuators over the machine width that are provided for regulation of a cross-direction profile may be additionally influenced by the second control loop to provide a uniform machine-wide adjustment of these actuators. This embodiment has the advantage that additional actuators are not necessary and that a simple and uncomplicated enhancement of a known paper or cardboard machine with a consistency-controlled headbox may be effected by adding the second control loop with a second sensor.

Of course, the above-noted features and further features to be explained below are not only applicable in each of the combinations given, but also in other combinations or in isolation, without departing from the scope of the invention.

Accordingly, the present invention is directed to a paper or cardboard machine for regulating a basis weight of a paper or cardboard web during a manufacturing process. The paper or cardboard machine includes at least one headbox that extends across a machine width. The at least one headbox is adapted to provide a machine-wide distribution of a material suspension onto one of a screen and between two screens. The machine also includes at least one material suspension supply coupled to the at least one headbox and adapted to supply a material suspension to the at least one headbox. The at least one material suspension supply has at least one concentration. At least one first control loop is provided that includes at least one actuator being adapted to adjust the at least one concentration of the at least one material suspension supply, at least one detector for determining a basis weight of a finished web, at least one supply being adapted to modify the at least one concentration of the at least one material suspension supply, and at least one device that adjusts the at least one actuator. In this manner, the at least one concentration of the at least one material suspension supply is adjusted. At least one second control loop is provided that is adapted to regulate the concentration of the material suspension supply.

In accordance with a further feature of the present invention, at least one sensor is adapted to determine the basis weight of a resulting web one of directly and indirectly, and the second control loop is coupled to at least one sensor. Further, the at least one sensor is positioned in a wet section of the paper or cardboard machine.

In accordance with another feature of the present invention, at least one second actuator is adapted to regulate an amount of thick matter to be supplied to the headbox, and the second control loop is coupled to at least one second actuator.

In accordance with another feature of the present invention, the at least one material suspension supply includes two material supplies having a high and low material concentration, respectively. Further, one of the two material supplies includes a regulatable input adapted to receive one of a thickening and a thinning fluid, and the regulatable input is coupled to and regulated by the second control loop. Still further, the one of the two material supplies with the low material concentration has the regulatable input. Further still, the one of the two material supplies with the high material concentration has the regulatable input.

In accordance with a still further feature of the present invention, at least one of the two material supplies includes a plurality of branches coupled to the headbox, and each branch is adapted to control an amount of flow.

The present invention is directed to a method for regulating a basis weight of a paper or cardboard web in the manufacturing process. The method includes determining a basis weight at an end of the manufacturing process, calculating a deviation of the determined basis weight from a predetermined target value, adjusting a concentration of a material suspension supplied to a headbox via a first control loop such that the calculated deviation is corrected, one of directly and indirectly measuring a basis weight of a resulting web in a region upstream, with regard to a web travel direction, a drying section, and supplying a signal related to the measured basis weight to a second control loop.

In accordance with a further feature of the present invention, further including regulating a concentration of the material suspension supplied to the headbox via the second control loop. The regulating of the concentration of the material suspension supplied to the headbox via the second control loop includes variably supplying an amount of one of a thinning and thickening fluid to the material suspension supplied to the headbox.

In accordance with another feature of the present invention, the material suspension supplied to the headbox is supplied in two separate supplies having a high and low concentration, and the regulating of the concentration of the material suspension supplied to the headbox via the second control loop includes regulating at least one of the two separate supplies via the second control loop.

In accordance with still another feature of the present invention, further including filtering the measured basis weight signal to suppress low-frequency variations prior to the second control loop.

In accordance with a still further feature of the present invention, further including filtering the determined basis weight signal to suppress high-frequency variations prior to the first control loop.

In accordance with another feature of the present invention, further including exchanging information between the first control loop and the second control loop such that conflicting adjustment and regulation of the material suspension concentration is substantially avoided.

The present invention is also directed to a machine for producing a web. The machine includes a headbox, a wet section having at least one screen, and a material suspension coupled to the headbox. The headbox is adapted to supply the material suspension into the wet section of the machine. At least one sensor is positioned within the wet section to one of directly and indirectly determine a basis weight of a resulting web, and at least one control loop is adapted to regulate a concentration of the material suspension supplied to the wet section.

In accordance with a further feature of the present invention, a second sensor is positioned within the headbox to determine a material consistency of the material suspension and being coupled to the at least one control loop.

In accordance with a still further feature of the present invention, a thinning medium supply and a thickening medium supply, the thinning and thickening medium supplies being coupled to the material suspension through regulatable devices, and the regulatable devices are adapted to be regulated by the control loop.

In accordance with yet another feature of the present invention, at least one detector for determining a basis weight of a finished web, at least one concentration supply is adapted to modify the concentration of the material suspension, at least one additional control loop, at least one actuator is coupled to the at least one concentration supply. The at least one actuator is adapted to be controlled by the at least one additional control loop.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
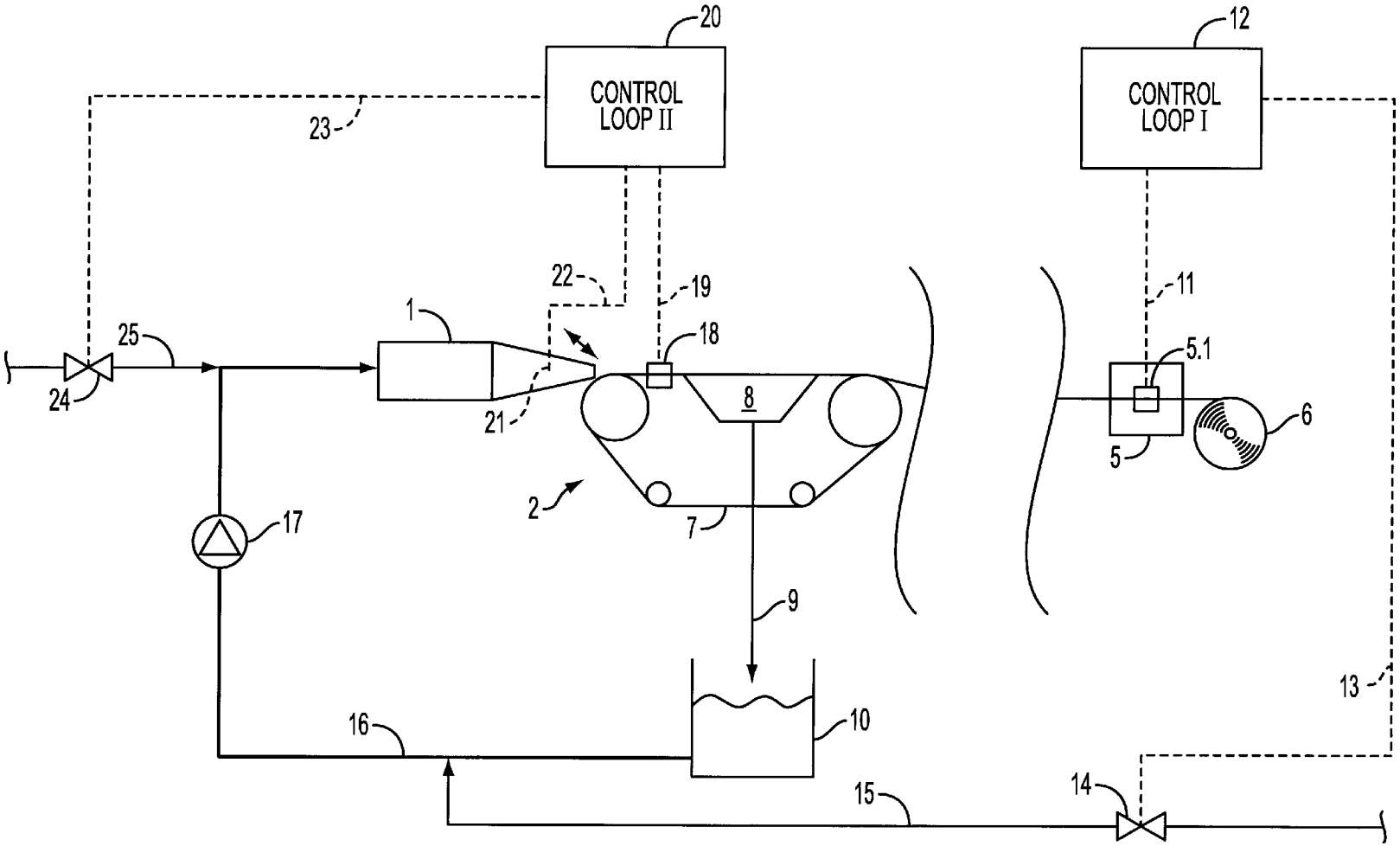
FIG. 1 illustrates a paper or cardboard machine in accordance with the present invention that includes a headbox with an adjustable aperture.

FIG. 1 schematically illustrates a paper or cardboard machine that regulates the basis weight of a web, e.g., paper or cardboard, to be produced and depicts only necessary parts of machine for regulating the basis weight in accordance with the present invention. The paper or cardboard machine include a headbox 1 and a subsequent wet section 2. A loading gauge 5 and a winding device 6 for the finished paper or cardboard web are depicted as located at an end of the machine. A first control loop I 12 is provided for regulating or controlling the basis weight of the paper or cardboard web by processing a signal from loading gauge 5 in accordance with a predetermined target value. A valve 14 (or other similar type actuator) is actuated by first control loop I 12 via a control line 13 to control the supply of thick matter supply 15 into a material suspension supply 16. In this manner, the concentration of the material suspension to be supplied to the headbox may be controlled or adjusted in a desired manner. Material suspension supply 16 may be provided within a closed screen (sieve) water circuit, may take screen water from a screen water container 10 and may supply the screen water concentrated with thick matter as material suspension to headbox 1. The above-described control loop I 12 generally corresponds with the prior art. In particular, control loop I 12 can be utilized only to determine and regulate long-wave (low-frequency) variations of the basis weight of the paper or cardboard. In order to regulate a surface-weight cross-direction profile, data or information about the measured cross-direction profile should generally be additionally forwarded to another control loop (not shown) to regulate or control the surface-weight cross-direction profile.

In accordance with the present invention, the device illustrated in FIG. 1 includes a second control loop II 20. Control loop II 20 receives measured values from a sensor 18 via a measuring line 19. Sensor 18 may be located in wet section 2 of the paper or cardboard machine that may include a circulating screen 7 positioned to receive the material suspension applied by headbox 1. In this exemplary illustration, sensor 18 may be arranged at the beginning of a draining interval. In this manner, control loop II 20 is relatively short, and thus, provides a quick reaction time. Control loop II 20 receives the measured information from sensor 18, correlates the measured information with a basis weight, and calculates the variation of the basis weight of the resulting paper or cardboard web and the necessary control adjustments.

In FIG. 1, sensor 18 may be, e.g., a thickness tester that forwards information related to layer thickness to control loop II 20 via measuring line 19. If it is assumed that the consistency of the material suspension is constant over the machine width, a determination about basis weight variations weight at the measuring location or about consistency variations can be made. If control loop II 20 receives information that layer thickness variations, and, thereby, the basis weight at the measuring location, the necessary modification or adjustment of the concentration of the material suspension to be supplied to the headbox can be calculated and, via a control line 23, an actuator, e.g., valve 24, may be controlled to vary the amount of an additional fluid supplied to material suspension line 16 via line 25 before the material suspension is supplied to headbox 1. In this manner, a fast control loop II 20 is added inside control loop I 12. Of course, only short variations, i.e., variations having a shorter wavelength, are equalized. Long-wave variations continue to be compensated through control loop I.

To enhance the measuring precision of control loop II 20, a material consistency sensor 21 may be positioned within headbox 1 and coupled to control loop II 20 via measuring line 22 to forward information related to material consistency. The additional information is utilized with the layer thickness measurement of second sensor 18 to provide a more precise measurement of the basis weight at the measuring location.

A significant advantage of control loop II 20 of the present invention is that the admixture of thinning or thickening fluid via line 25 is applied very closely to headbox 1. In this manner, very short control regions are formed, which permit the compensation of very short-wave variations in the system, while the regulations over control loop I 12 run sluggishly.

A further enhancement of the present system includes an additional filter in control loop II 20 to stabilize the short-wave variations in the basis weight of the paper or cardboard web. Likewise, an additional filter may be provided in control loop I 12 to stabilize long-wave variations of the basis weight of the paper or cardboard web. In this manner, a clear division of tasks is established between control loop I 12 and control loop II 20. Moreover, an exchange of information between control loop I 12 and control loop II 20 can occur so that conflicting control commands may be avoided.

Figure 2:
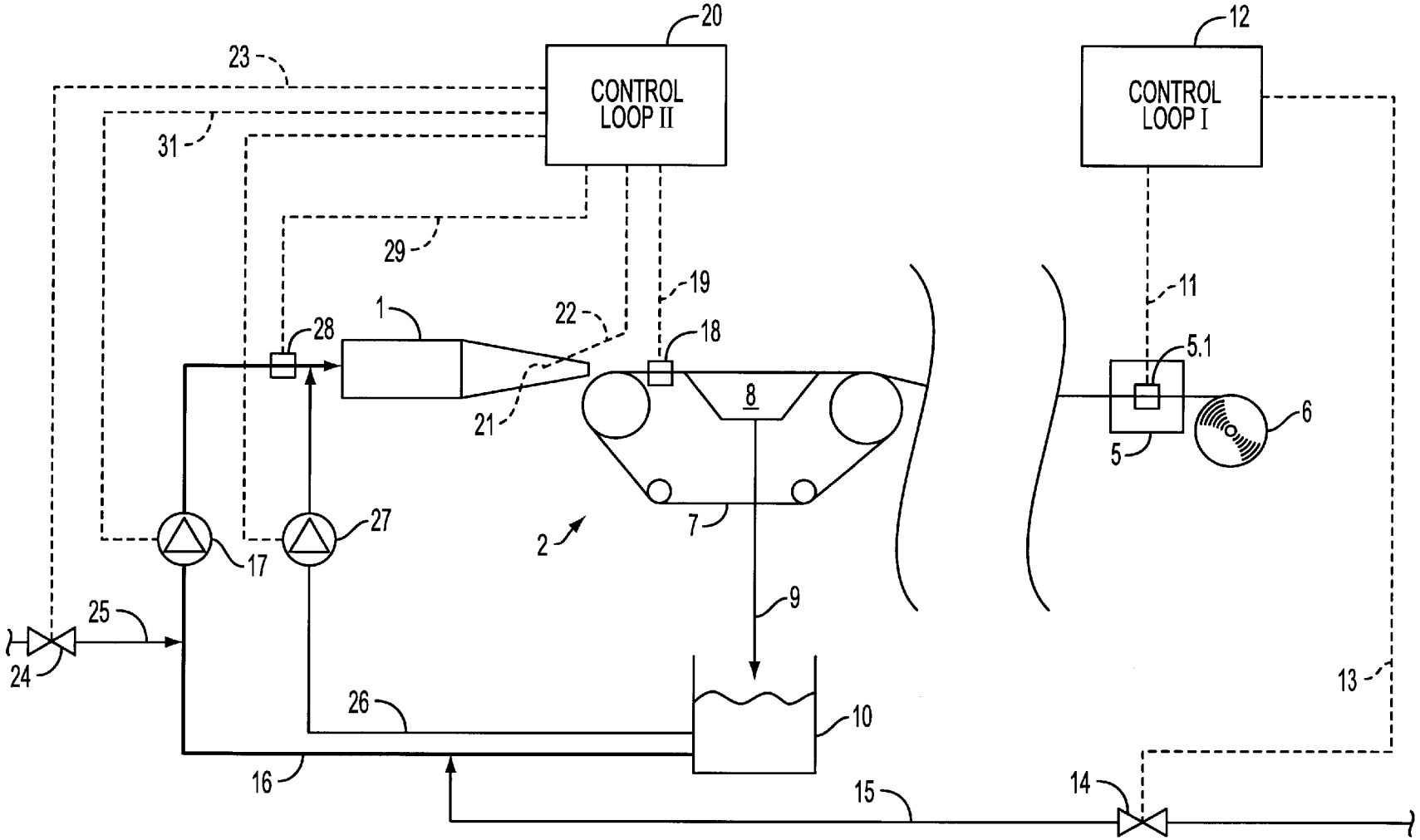
FIG. 2 illustrates a paper or cardboard machine with a sectioned headbox that is sectionally regulated for consistency and that includes a second control loop for fast, machine-wide surface-weight regulation.

An alternative embodiment of the present invention is illustrated in FIG. 2. FIG. 2 schematically illustrates the paper or cardboard machine substantially similar to that depicted in FIG. 1, i.e., including headbox 1, wet section 2, and winding device 6. A loading gauge 5, which includes a sensor 5.1, is positioned prior to winding device 6. Sensor 5.1 is utilized to forward information related to the basis weight of the paper or cardboard web, i.e., at the end of the manufacturing process, to control loop I 12 and to enable control of actuator 14 to adjust the amount of thick matter supplied to material suspension supply 16 via line 15.

In this embodiment, headbox 1 is coupled not only to material suspension line 16, but also to an additional screen-water line 26. In this manner, the material suspension of line 16 in the region of headbox 1 may be further diluted, if necessary. Line 26 is branched into a plurality of individual lines (not shown) distributed over the machine width in the region of headbox 1. In this manner, regulation of the surface-weight cross-direction profile can be provided via controlling the supply of screen water through the feed lines associated with sections of headbox 1. While control loop I 12 is provided for the surface-weight cross-direction profile, this control loop is not taken into consideration at this point because it does not govern the basis weight of the overall web, but rather, the profile.

In accordance with the present invention, second control loop II 20 is provided to receive information from sensor 18 about the basis weight adjacent to wet section 2. The measurement of the basis weight can be further assisted by a material consistency sensor 21 mounted in headbox 1 that forwards data via measuring line 22 to a process control system. Further, an inductive flowmeter 28 may coupled to control loop 20 via measuring line 29 to provide information related to the material suspension flow through material suspension line 16. In this way, variations in the material suspension amount supplied to headbox 1 are regulated by control loop II 20 via pump 17 and a control line 31, and the concentration of the material suspension may be adjusted or controlled by adding thinning or thickening media through line 25. Valve 24 is coupled to line 23 of control loop II 20 to control or adjust the concentration of the material suspension through line 25. Moreover, the concentration of the material suspension to be supplied to headbox 1 over line 16 can be adjusted via screen water through line 26. Pumps 17 and 27 may be controlled by control loop II 20 to further adjust the material thickness.

Figure 3:
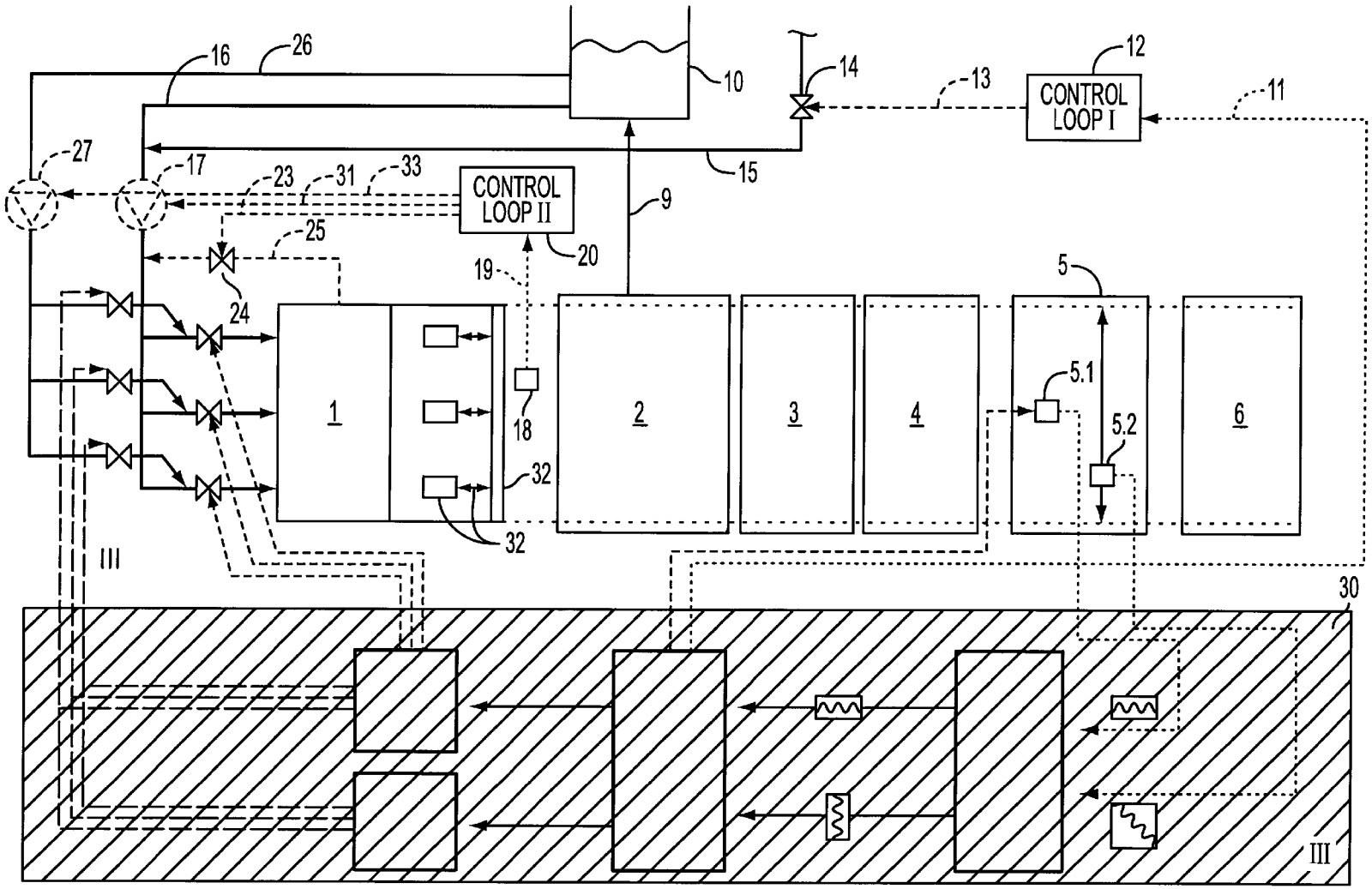
FIG. 3 illustrates a paper or cardboard machine with a consistency-controlled headbox having an adjustable aperture, cross-direction profile regulation and a second control loop for fast regulation of the longitudinal profile.

In FIG. 3, a paper or cardboard machine having a sectioned headbox 1 is illustrated. Headbox 1 is sectioned over the machine width and the sections are consistency regulated. Sensor 18, positioned immediately following headbox 1, is utilized to measure the amount of material suspension amount ejected from headbox 1. Sensor 18 may be, e.g., a radiometric sensor for measuring material mass. Wet section 2, press section 3, and drying section 4 of the paper or cardboard machine follow sensor 18. Drying section 4 is coupled to loading gauge 5 and is positioned upstream therefrom. Loading gauge 5 may include two sensors 5.1 and 5.2. Sensors 5.1 and 5.2, of which at least sensor 5.2 traverses the machine width, forward information to the surface-weight control loop (control loop I 12) and if appropriate, to a fiber-orientation/cross-direction profile control loop 30 to calculate an actual cross-direction profile and longitudinal profile of the paper or cardboard web. In this manner, a subsequent activation of sectioned partial streams to headbox 1 can be controlled. The information about the basis weight of the paper or cardboard web is determined from this measurement circuit and is forwarded, via line 11, to control loop I. As already described above, control loop I 12 controls or regulates the supply of thick matter via line 15 to the material suspension stream supplied to headbox 1, and thereby, the basis weight of the manufactured paper or cardboard web.

Second control loop II 20 may be provided to receive data from sensor 18 via measuring line 19 and to regulate an additional supply of a dilution fluid to the primary material suspension stream. In this manner, the short-wave variations of the basis weight of the manufactured paper or cardboard web, which cannot be regulated with control loop I 12, may be stabilized. Thus, paper or cardboard quality is improved.

The operation of surface-weight cross-direction profile control loop 30, depicted in hatched and outlined part III, is described in a detailed manner in the above-cited patent application DE 20 19 975.

Figure 4:
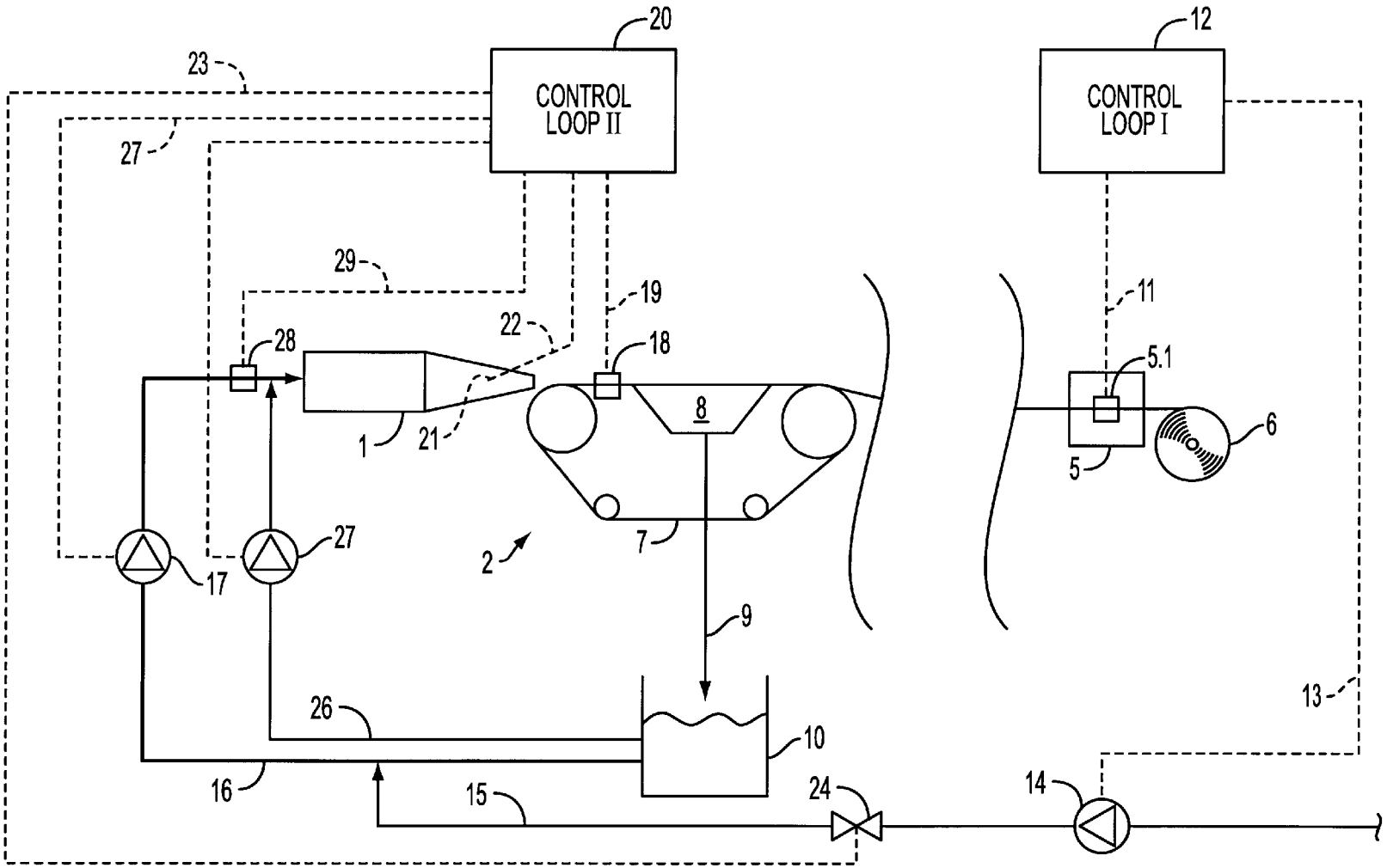
FIG. 4 illustrates a paper or cardboard machine with a sectioned headbox that is sectionally regulated for consistency and a second control loop for the fast, machine-wide surface-weight regulation with control over a thick matter supply.
Figure 5:
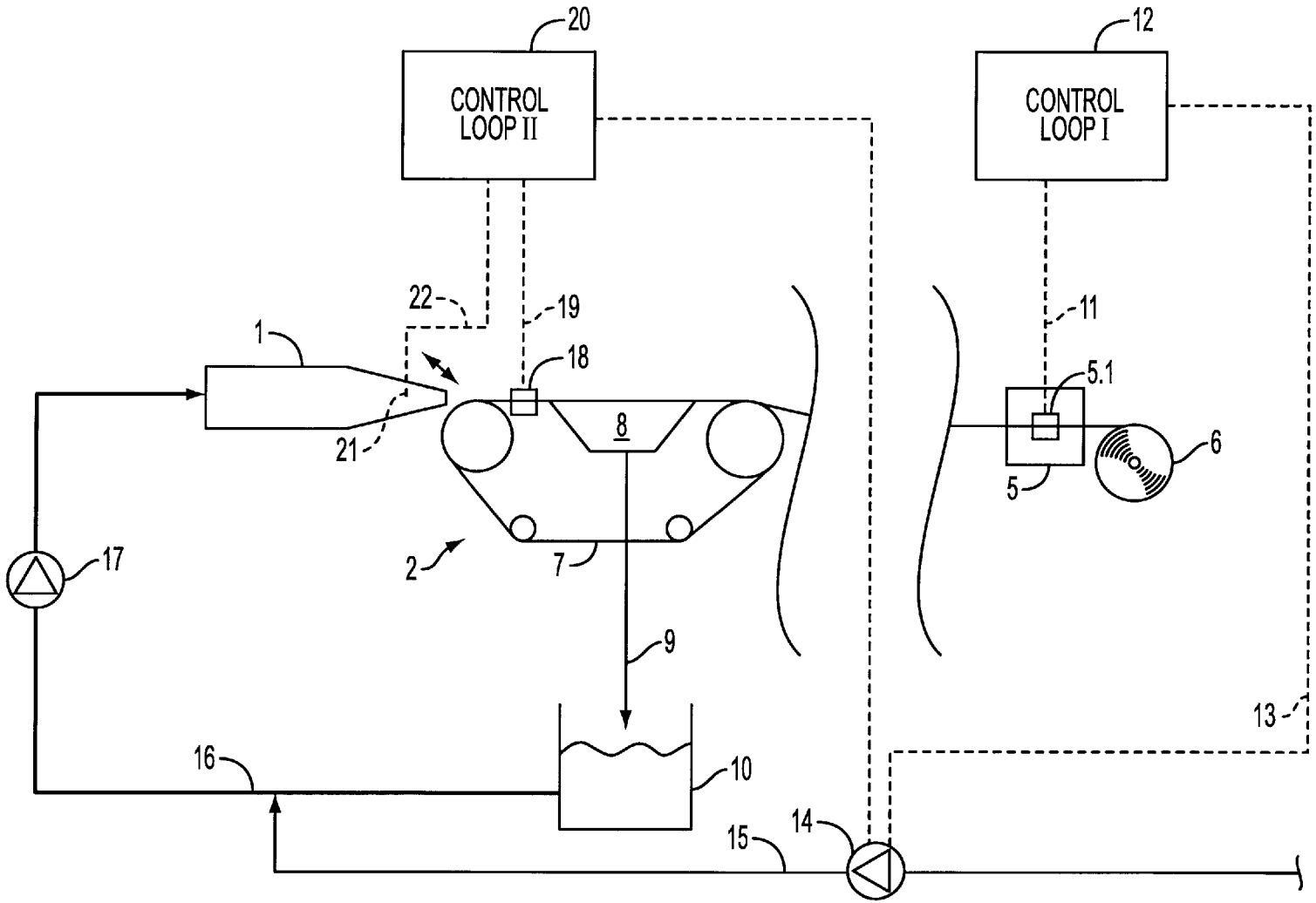
FIG. 5 illustrates a paper or cardboard machine with a headbox having an adjustable aperture and a second control loop that controls a speed-regulated pump to supply thick matter to the material suspension supply.

FIGS. 4 and 5 illustrate embodiments of a paper or cardboard machine which substantially correspond to the embodiments depicted in FIGS. 1 and 2. However, in contrast to FIGS. 1 and 2, regulation of the material concentration in FIGS. 4 and 5 is not achieved by supplying thinning or thickening fluid to the material suspension supplied to headbox 1. Rather, control loop I 12, via line 13, controls an actuator 14 that meters the addition of thick matter in a known manner into the primary material suspension stream to be supplied to headbox 1. While this embodiment has a slight disadvantage that the control region is increased in size, whereby regulation becomes somewhat more sluggish than in the embodiments depicted in FIGS. 1–3, the technical expense is significantly lower. Thus, a considerable expense-related advantage is obtained in these alternative embodiments. Moreover, these embodiments may be adapted without complication to existing paper or cardboard machines.

Figure 6:
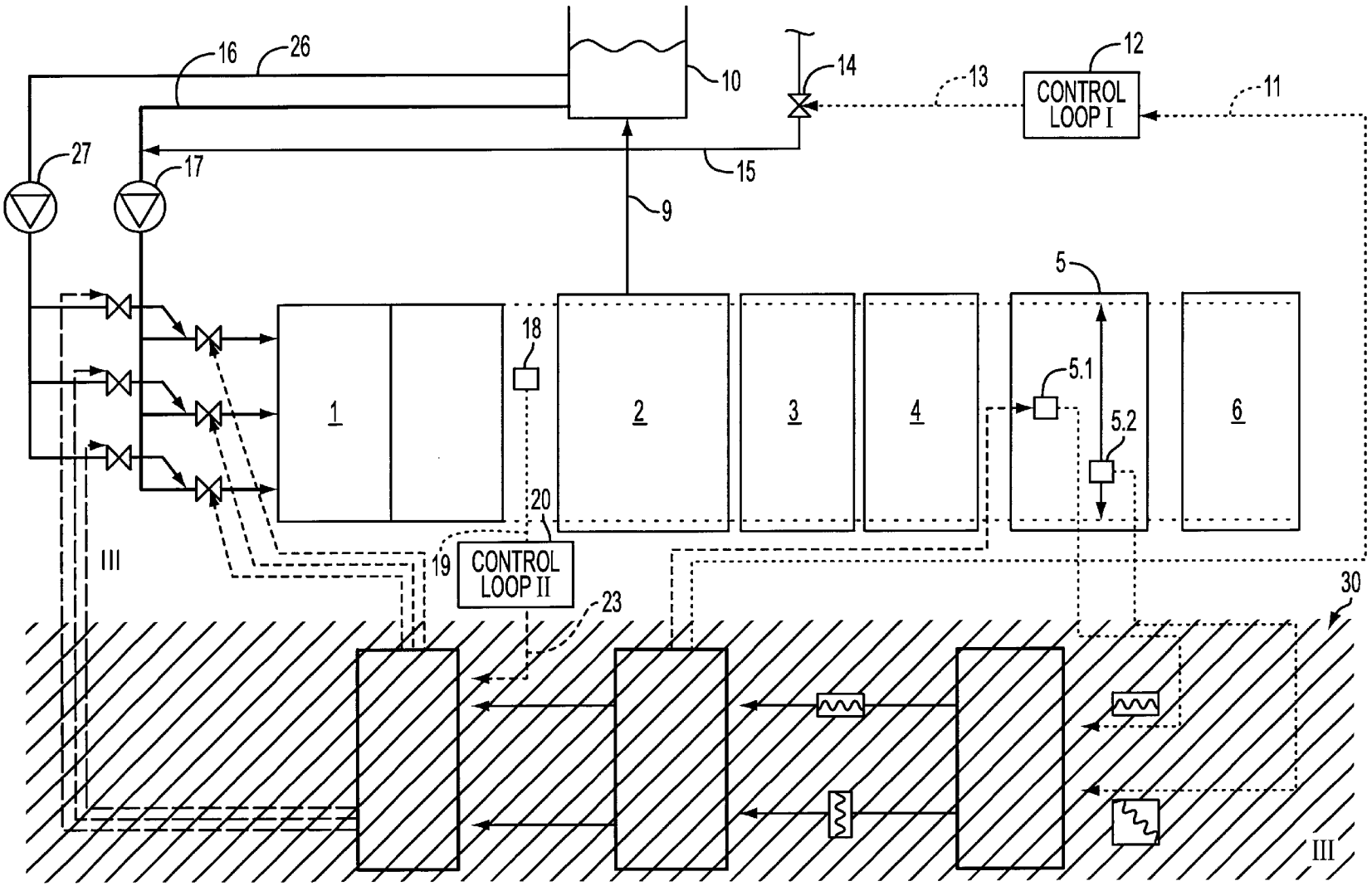
FIG. 6 illustrates a paper or cardboard machine with a consistency-controlled headbox with an adjustable aperture, cross-direction profile regulation and a second control loop for fast regulation of the longitudinal profile with a machine-wide, uniform control of the material concentration via the actuators of the cross-direction profile regulation.

Another alternative embodiment in accordance with the present invention is illustrated in FIG. 6. This alternative embodiment is similar to the embodiment depicted in FIG. 3, however, control loop II 20 is coupled to cross-direction profile control loop III via control line 23. Accordingly, a machine-wide adjustment of actuators for regulating the surface-weight cross-direction profile may be provided, and therefore, a machine-wide increase or decrease of the material concentration is obtained.

In accordance with this embodiment, a very rapid control loop is realized. In this manner, it is advantageous that no additional actuators, i.e., beyond those normally present in a consistency-controlled headbox, are necessary.

In accordance with the embodiments depicted in the Figures and described above, it is possible to attain significantly better results with the regulation of the basis weight in the manufacture of a paper or cardboard or cardboard web in comparison with the prior art. In particular, in accordance with the features of the present invention, regulation is available to equalize short-wave variations in the basis weight of the paper or cardboard web.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCES

| | |
|---|---|
| 1. | Headbox |
| 2. | Wet section |
| 3. | Press section |
| 4. | Dry section |
| 5. | Measuring frame |
| 5.1, 5.2 | Sensor |
| 6. | Take-up device |
| 7. | Screen |
| 10. | Screen water container |
| 13. | Control line |
| 14. | Valve/actuator |
| 15. | Thick matter supply |
| 16. | Material suspension supply |
| 17. | Pump |
| 18. | Sensor |
| 19. | Measuring line |
| 21. | Material consistency sensor |
| 22. | Measuring line |
| 23. | Control line |
| 24. | Valve |
| 25. | Line |
| 26. | Additional screen water line |
| 27. | Pump |
| 28. | Flowmeter |
| 29. | Measuring line |
| 30. | Surface-weight cross-direction profile control loop |
| 31. | Control line |
| 32. | Headbox aperture with adjustment devices |
| 33. | Control line |

What is claimed is:

1. A method for at least one of controlling and regulating a basis weight of a paper or cardboard web during the manufacturing process comprising:

determining a basis weight at an end of the manufacturing process;

calculating a deviation of the determined basis weight from a predetermined target value;

adjusting a concentration of a material suspension supplied to a headbox via a first control loop, whereby the calculated deviation is corrected;

one of directly and indirectly measuring a basis weight of a resulting web in a region upstream, with regard to a web travel direction, a drying section; and supplying a signal related to the measured basis weight to a second control loop, separate from the first control loop, whereby the basis weight of the web is at least one of controlled and regulated.

2. The method in accordance with claim 1, regulating a concentration of the material suspension supplied to the headbox via the second control loop.

3. The method in accordance with claim 2, the regulating of the concentration of the material suspension supplied to the headbox via the second control loop comprising variably supplying an amount of one of a thinning and thickening fluid to the material suspension supplied to the headbox.

4. The method in accordance with claim 1, wherein the material suspension supplied to the headbox is supplied in two separate supplies having a high and low concentration, and the regulating of the concentration of the material suspension supplied to the headbox via the second control loop comprising regulating at least one of the two separate supplies via the second control loop.

5. The method in accordance with claim 1, further comprising:

filtering the measured basis weight signal to suppress low-frequency variations prior to the second control loop.

6. The method in accordance with claim 1, further comprising:

filtering the determined basis weight signal to suppress high-frequency variations prior to the first control loop.

7. The method in accordance with claim 1, further comprising:

exchanging information between the first control loop and the second control loop, whereby conflicting adjustment and regulation of the material suspension concentration is substantially avoided.

* * * * *